United States Patent [19]

Hall

[11] 4,307,583

[45] Dec. 29, 1981

[54] FIXTURE FOR ALIGNING SHAFTS FOR CONNECTION

[75] Inventor: John W. Hall, Lusby, Md.

[73] Assignee: The United States of America as represented by the Secretary of the Navy, Washington, D.C.

[21] Appl. No.: 150,388

[22] Filed: May 16, 1980

[51] Int. Cl.[3] ..... F04B 21/00

[52] U.S. Cl. ..... 64/4; 64/3; 123/195 A

[58] Field of Search ..... 64/4, 3; 123/195 A

[56] References Cited

U.S. PATENT DOCUMENTS

| | | | |
|---|---|---|---|
| 2,709,924 | 6/1955 | Castelli | 74/571 |
| 2,985,474 | 5/1961 | Cook | 123/195 A UX |
| 3,097,543 | 7/1963 | Godsil et al. | 74/563 |
| 3,435,778 | 4/1969 | Ascuitto et al. | 64/4 |
| 3,523,491 | 8/1970 | Howell | 64/4 |
| 3,643,642 | 2/1972 | Junes | 123/195 A |
| 3,868,833 | 3/1975 | Noe et al. | 64/4 |
| 4,214,457 | 7/1980 | Wade et al. | 64/4 |
| 4,217,767 | 9/1980 | Eckley | 64/3 |

*Primary Examiner*—Wendell E. Burns

[57] ABSTRACT

A fixture for use in mounting an accessory on the frame of an engine or machine and adapted for adjustments for aligning a shaft of the accessory with a power take-off shaft of the machine. The fixture comprises a housing in two parts, one of which is adapted for attachment to the frame of the engine and the other is adapted to receive the accessory. The housing includes means for angularly and laterally positioning the accessory shaft for aligning it in concentricity with the power take-off shaft.

15 Claims, 7 Drawing Figures

ANGULAR AND ECCENTRIC MISALIGNMENT

ECCENTRIC MISALIGNMENT ONLY

TRUE ALIGNMENT

FIXTURE FOR ALIGNING SHAFTS FOR CONNECTION

BACKGROUND OF THE INVENTION

Rotating machinery involves transmission of rotary power through shafts which are often drivingly connected end-to-end through couplings. It is necessary to align such shafts and couplings to minimize bending stresses, axial loads and angular velocity disturbances which cause wear fatigue and failure of rotating machinery. In the past, shaft and coupling misalignments have been measured and attempts to correct the misalignment have been limited to shimmering of various components, or remachining of components to bring the drive shaft and couplings into alignment. Tedious shimmering and measurement procedures were used to achieve the desired alignment. In addition to bring a trying trial and error procedure, shimmering for shaft alignment does not offer an appropriate degree of precision or repeatability, and there is deformation of components upon improper bolt torquing.

The present invention is concerned with apparatus for overcoming some of the difficulties mentioned above. It provides a two part accessory-carrying housing which is adapted for relative pivotal adjustment on itself for both angularly and laterally shifting the accessory shaft for aligning it axially with the axis of a power take off shaft on an engine or other machine.

SUMMARY OF THE INVENTION

This invention is directed to a fixture for use in mounting an accessory on the frame of an engine or machine such as an aircraft engine, or other machine where shafts are to be axially aligned and connected for transmission of rotary power from one to the other. The fixture includes a two part housing, one obliquely mounted on the other so that their longitudinal axis can be selectively positioned angularly to aligned or misaligned relationships. An inner or first part of the housing is adapted to be attached to the frame of the engine or machine, in surrounding and axially aligned relationship with a shaft such as a power take-off shaft. An outer or second part of the housing is adapted to mount the accessory at its outer end with the accessory shaft pointing generally toward the shaft at which it is to be axially connected. Some initial misalignment is assumed as a normal condition. This initial misalignment may include either lateral or angular displacements, or both. The outer part of the housing, with the accessory attached, is selectively pivoted on the inner part for angularly positioning the accessory shaft axis parallel with the power take-off shaft. Thereafter, eccentric means on the outer part is adjusted to reposition the accessory laterally so that its shaft axis is shifted from parallelism with the power take-off shaft into alignment or concentricity therewith.

OBJECTS OF THE INVENTION

An object of the invention is to provide an adjustable fixture for mounting an accessory on an engine or other machine.

Another object of the invention is to provide an adjustable fixture capable of mounting an accessory on an engine and upon adjustment to align a shaft carried on the accessory with a power take-off shaft of the engine.

Still another object of the invention is to provide an adjustable fixture which carries a connector for connecting the aligned shafts for transmitting rotary power therebetween.

DESCRIPTION OF THE PREFERRED EMBODIMENT

Figure 1A:
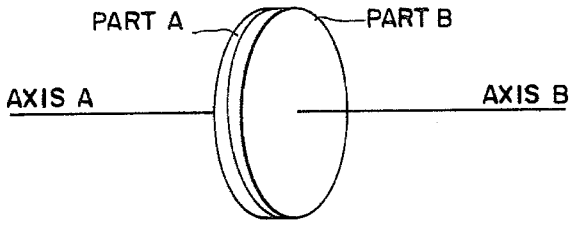
FIGS. 1*a* and 1*b* illustrate a principle of one feature of the invention.
Figure 1B:
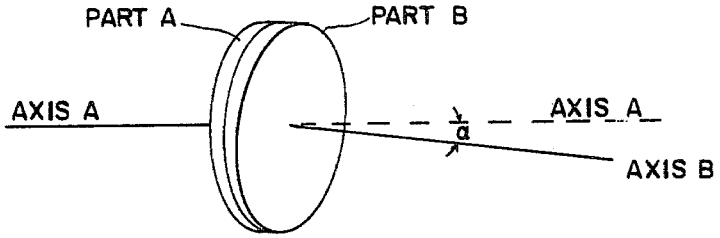

Referring now to FIGS. 1*a* and 1*b*, there is shown mating discs, each provided with a face disposed on a plane oblique to axis of respective discs. The thickness of each disc varies around its circumference to define axial cams. When parts A and B are arranged according to the FIG. 1*a* illustration, axis A and axis B are aligned or coaxial. If one of the discs is rotated about its axis, while the other disc is held stationary, their axis become misaligned by an angle $\alpha$ according to the FIG. 1*b* arrangement. This principle, coupled with apparatus for shifting another part laterally for eccentricity illustrates the operation of a fixture embodying the invention.

Figure 2:
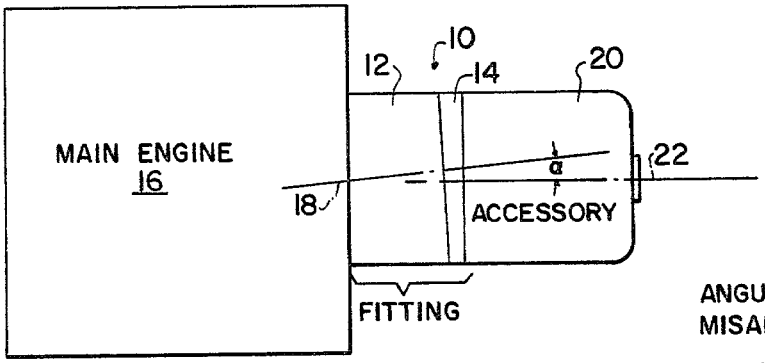
FIG. 2 is a representation of the fixture mounting an accessory on a main engine, and illustrating an initial axial misalignment.
Figure 3:
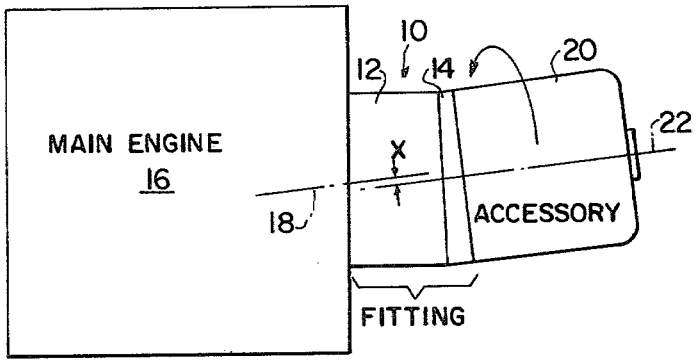
FIG. 3 is a representation similar to FIG. 2 illustrating an angular adjustment of the axis of the accessory.
Figure 4:
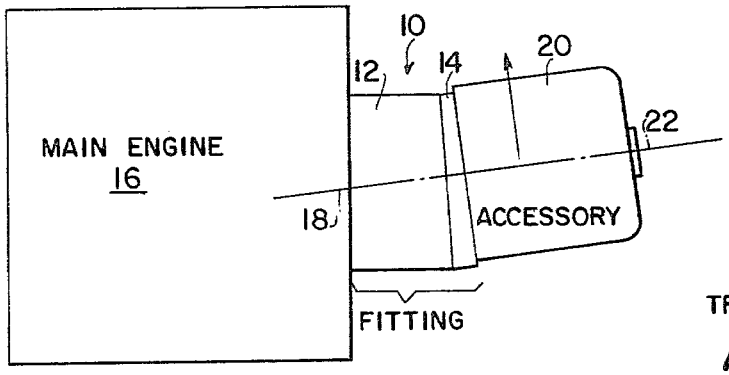
FIG. 4 is a representation similar to FIG. 3 but showing a lateral shift in the accessory relative to the fixture.

FIGS. 2, 3, and 4 illustrate schematically in exaggeration a fixture mounting an accessory on a main engine or other machine and the steps necessary for aligning the axis of the accessory shaft axially with a power take-off shaft extending from the main engine so that rotary power can be transmitted therebetween under conditions of near perfect alignment.

In FIG. 2 there is shown a fixture, designated generally by the number 10, comprised of two parts, 12 and 14, connected together in general axial alignment. The parts mate along obliquely disposed faces and are provided for limited relative pivotal adjustment. The inner or first part 12, which is in the form of a housing, is secured to the frame of a main engine, such as an aircraft engine, or other machine 16. It surrounds and is generally coextensive with a shaft such as a power take-off shaft 38 (not shown), having an axis 18. The outer or second part 14, also forming part of a housing, is adapted to mount accessory 20 on its outboard extremity. The accessory includes a shaft 48 (not shown) which extends toward the main engine along axis 22. In practice, even when parts and mating surfaces such as shafts are machined under close tolerance, some misalignment (angular and/or lateral), ever so minute, will invaribly exist. This angular misalignment is represented in exaggeration by angle $\alpha$ in FIG. 2. While, in practice, the misalignment may be only slight, at high speeds over extended periods it becomes critical.

In order to align axis 22 of accessory 20 with axis 18 of the power take-off shaft, two steps must be taken. By a first step, outer housing part 14 is rotated as necessary from the FIG. 2 position about its axis with respect to part 12 to bring its axis into as close alignment as possible with respect to axis 18. In the position to which rotated, most likely the two axis will be eccentric, parallel or laterally offset from each other by some small dimension X as illustrated in FIG. 3. By the next step, accessory 20 is adjusted laterally relative to outer part 14 to the position illustrated in FIG. 4 to bring axis 22 into precise alignment with axis 18 of the power take-off shaft. The mechanism by which accessory 20 is adjusted to a new position on part 14 is described later in the specification. A connector (not shown in FIGS. 2, 3 or 4) is adapted for connection over the nearly perfectly aligned shafts for transmitting torsional force from one to the other.

Figure 6:
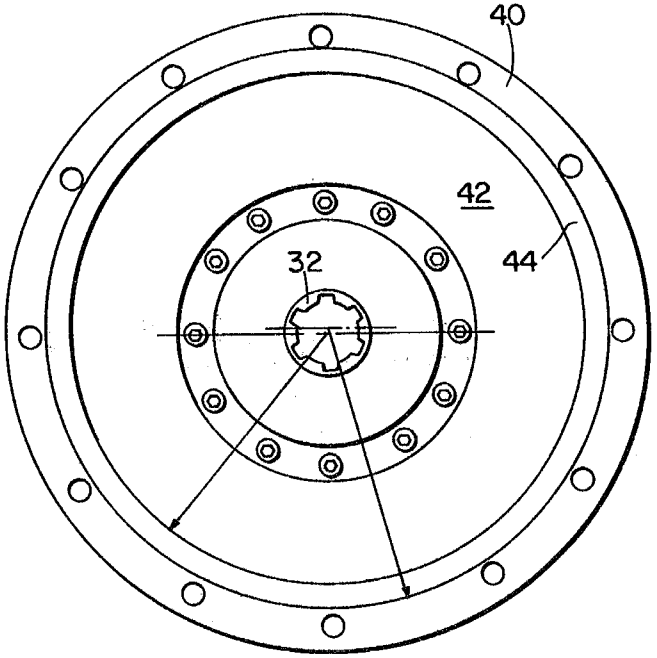
FIG. 6 is an end view of the fixture in FIG. 5 taken along line 6—6 of FIG. 5.
Figure 5:
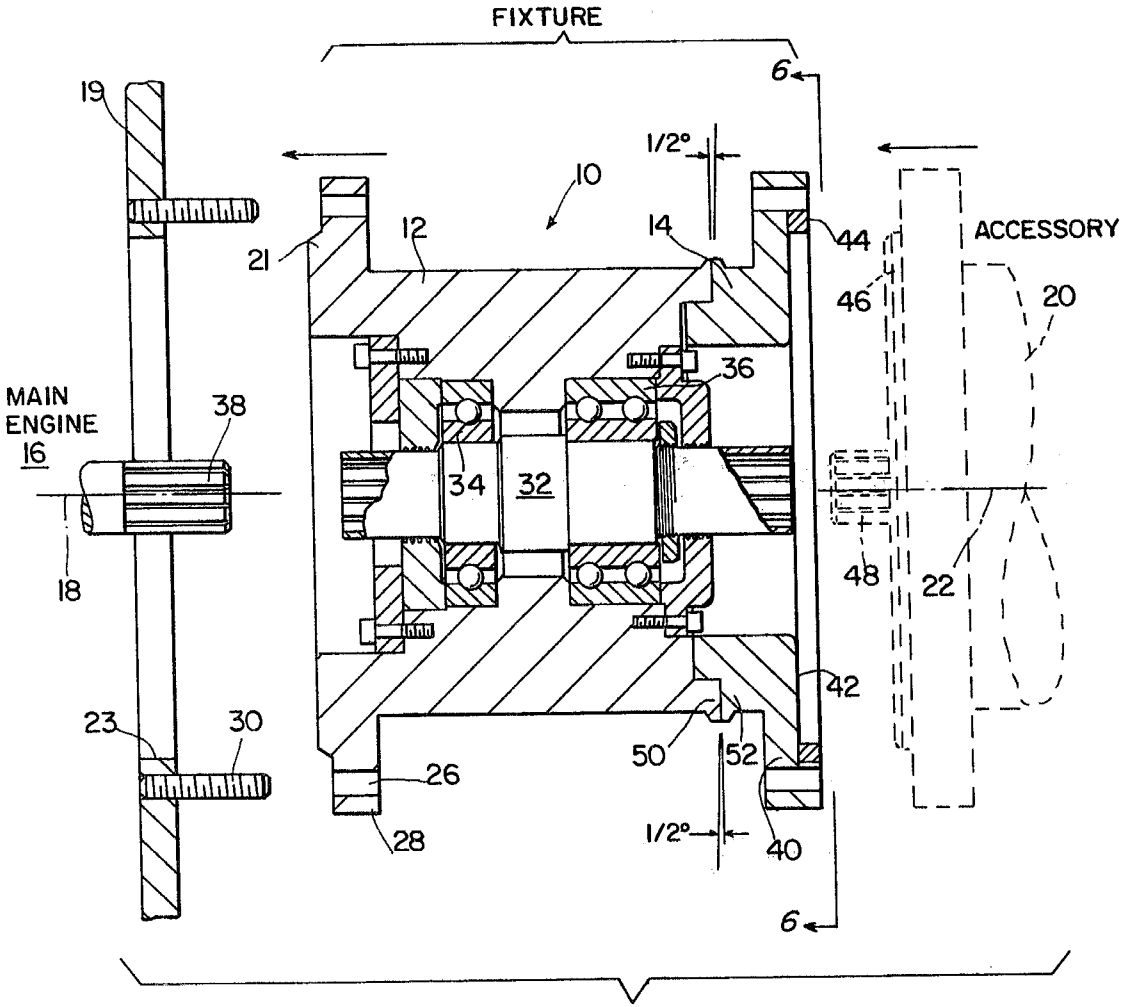
FIG. 5 is a longitudinal cross-sectional view of the fixture adapted for mounting on the main engine for carrying an accessory illustrated in phantom lines.

Referring now to FIG. 5, there is shown a longitudinal cross-sectional view of fitting 10. As illustrated in FIG. 5, the fitting is spaced a short distance from frame 19 of main engine 16 on which it is to be mounted. Cylindrical projection 21 on the end of housing part 12 is adapted to snugly seat in opening 23 of the frame, with holes 26, arranged about annular flange 28, adapted to be aligned over lugs 30 for securing by nuts (not shown). Outer part 14 of the housing is adapted to mount on its outboard end an accessory 20, shown in phantom. The inner or first part 12 of the housing rotatably carries on internally splined connector 32 mounted on a pair of spaced apart antifriction bearings 34 and 36. Housing part 12 is mounted on frame 19, and connector 32 aligned with and received on shaft 38 of the main engine. Outer or second part 14 of the housing is mounted on part 12 for limited relative pivotal adjustment thereon. Flange 40 on the outboard end of part 14 is provided with a shallow cylindrical recess 42 which is offset or eccentric with respect to the axis of connector 32 by around 0.030". As shown in FIGS. 5 and 6, recess 42 receives annular ring 44. The inner opening of ring 44 is offset or eccentric with respect to the outer cylindrical surface also by about 0.030". When accessory 20 is mounted on flange 40 (by bolts or other means not shown), projection or nose 46 seats inside eccentric ring 44. Shaft 48 may be shifted laterally with respect to the axis of connector 32 by selectively rotary positioning of ring 44 in eccentric recess 42. In one position, the eccentricity of ring 44 and the eccentricity or recess 42 are added whereby the maximum eccentricity of shaft 48 with respect to connector 32 may be as much as 0.060". Upon repositioning or readjusting ring 44 by 180°, the eccentricity of ring 44 and eccentricity of recess 42 negate each other so that shaft 48 is aligned or eccentric with axis 18 and the axis of connector 32. Eccentricity of shaft 48 (axis 22) with respect to shaft 38 (axis 18) is noted in FIG. 3 by the dimension X. Axis 18 and 22, however, are adapted to be positioned so that they are parallel. Eccentricity X may be "dialed out" by adjusting ring 44.

Mating faces 50 and 52 on respective housing parts 12 and 14 lie in planes disposed obliquely with respect to axis of their parts. As shown in FIG. 5, each of these faces is inclined by about ½° from planes normal to the parts' respective axis. As outer part 14 is rotatably adjusted about its own axis, with its face 52 in sliding contact with face 50 or part 12, as viewed in FIG. 5, the axis of part 14 gyrates as does axis B, illustrated in FIG. 1. Since both faces 50 and 52 are obliquely disposed, the axis of part 14, which is concentric with axis 22 of accessory 20, may be selectively aligned with or at least parallel with the axis of part 12. Apparatus (not shown) selectively clamps 12 and 14 together in fixed position. Thereafter, accessory 20 may be adjusted laterally on part 14 to bring its shaft into alignment.

The present fixture can be used to "dial out" inherent shaft misalignments in rotating machinery. The fixture provides an arrangement to precisely align interfacing shafts. As an example, the two part fixture may be used for mounting a starter or generator on an engine or other machine. In that case, the fitting would provide means for precisely aligning the starter or generator shaft with the engine power take-off shaft, thus eliminating the destructive stresses which would otherwise be applied to the shaft coupling and seals due to shaft misalignment. For the purpose of this disclosure, the term power take-off shaft is meant to define an auxiliary shaft on an engine or machine for supplying or receiving rotary power.

A fitting as described allows infinite axial lateral adjustment up to around 1° and infinite eccentric or angular adjustments up to 0.060". This range of adjustment is generally broad enough to overcome a vast majority of misalignment conditions in shafts to be connected for rotary power transmission. Oblique faces disposed at greater or smaller angles may be selected as required.

There has been described an embodiment of an invention for aligning shafts. Obviously, many modifications and variations of the present invention are possible in light of the above disclosure. It is therefore to be understood that the scope of the invention is defined by the claims and is only limited thereby.

What is claimed is:

1. A fixture for use in mounting an accessory on a machine and adapted for adjustments for aligning a shaft of the accessory with a power take-off shaft extending from the machine comprising:
   - a housing in two parts;
   - a first part adapted to be attached to the frame of the machine and surrounding the power take-off shaft on the machine coaxially therewith;
   - a second part carried outboard of the first part and adapted to receive an accessory having a shaft extending axially of the second part and directed toward the power take-off of the machine;
   - said first and second parts obliquely mounted with respect to their axis so that upon selective rotation of the second part its axis may be angularly positioned with respect to the first part;
   - means on the second part for selectively positioning the accessory so that the axis of its shaft may be selectively adjusted laterally;
   - whereby upon adjustments the axis of the accessory shaft is adapted to be shifted angularly and laterally for alignment with the axis of the power take-off shaft.

2. The invention according to claim 1 including a connector for connecting the accessory shaft in axial alignment with the power take-off shaft.

3. The invention according to claim 1 wherein a connector is rotatably carried by the first part for connecting the shaft of the accessory with the power take-off shaft.

4. The invention according to claim 2 wherein the connector is rotatably carried by the first part.

5. The invention according to claim 3 wherein the connector includes internal splines at each end for rotary power transmission between the shafts.

6. The invention according to claim 4 wherein the connector includes splines at each end for transmission of rotary power between the shafts.

7. The invention according to claim 1 wherein the second parts defines an outboard part for receiving the accessory and includes means for selectively positioning the accessory thereon so that the axis of the accessory shaft may be positioned concentrically with the axis of the outboard part or in selected eccentricity thereof.

8. The invention according to claim 1 wherein the oblique mounting between the first and second parts includes mating surfaces disposed at oblique angle with respect to respective axis of the parts.

9. The invention according to claim 1 wherein the oblique angles are around ½° whereby the axis of the parts may be misaligned in infinite increments up to around 1°.

10. The invention according to claim 1 including means for maintaining the first and second parts in selected positions.

11. The invention according to claim 8 including means for maintaining the first and second parts in selected positions.

12. A fixture for use in mounting an accessory on a machine and adapted for adjustments for aligning a shaft on the accessory with a power take-off shaft on the machine comprising:

a housing including a first part rotatably carrying a shaft connector and adapted to be mounted on the frame of the machine with the connector drivingly secured to the power take-off shaft in axial alignment therewith;

said housing including a second part in the form of a ring mounted outboard which is adapted to mount an accessory with a shaft thereof extending inwardly for axial connection with the connector;

said first and second parts mounted on mating surfaces disposed at oblique angles with respect to their axis so that upon selective rotational adjustment of the second part its axis may angularly disposed into alignment or parallelism with the axis of the first part;

said second part including means for selectively adjusting the accessory so that the axis of its shaft may be shifted laterally with respect to the axis of the second part;

whereby upon rotational adjustment of the second part and lateral adjustment of the accessory on the second parts the axis of the accessory shaft may be brought into alignment with the connector for attachment and transmitting of rotary power.

13. The invention according to claim 12 wherein the connector includes splines at its opposite end for connection with the ends of the respective shafts.

14. The invention according to claim 1 including means for maintaining the first and second parts in selected adjusted positions.

15. The method of mounting an accessory on an engine and aligning its shaft with a power take-off shaft on the engine comprising:

mounting an adjustable fixture on an engine surrounding the power take-off shaft;

mounting an accessory on the fixture with its shaft extending generally toward the power take-off shaft;

adjusting the fixture for angularly positioning the axis of the accessory shaft parallel to the axis of the power take-off shaft; and shifting the accessory on the fixture for moving its shaft laterally whereby its axis is moved from parallelism to concentricity with the power take-off shaft.

* * * * *